US007979194B2

(12) United States Patent
Wilhelm et al.

(10) Patent No.: US 7,979,194 B2
(45) Date of Patent: Jul. 12, 2011

(54) SYSTEM AND METHOD FOR CONTROLLING FUEL INJECTION

(75) Inventors: Daniel D. Wilhelm, Nashville, IN (US); David L. Buchanan, Westport, IN (US)

(73) Assignee: Cummins Inc., Columbus, IN (US)

( * ) Notice: Subject to any disclaimer, the term of this patent is extended or adjusted under 35 U.S.C. 154(b) by 332 days.

(21) Appl. No.: 11/778,397

(22) Filed: Jul. 16, 2007

(65) Prior Publication Data

US 2009/0024299 A1 Jan. 22, 2009

(51) Int. Cl.
*F02D 41/00* (2006.01)
*F02M 51/00* (2006.01)

(52) U.S. Cl. ..... 701/104; 123/445; 123/490; 701/105

(58) Field of Classification Search ..... 123/478, 123/479, 480, 490, 445; 701/102, 114, 103, 701/104, 105; 361/152, 154
See application file for complete search history.

(56) References Cited

U.S. PATENT DOCUMENTS 2,348,113 A * 5/1944 Davis ..... 417/3
3,363,614 A * 1/1968 Fisher ..... 123/450
4,922,878 A 5/1990 Shinogle et al.
5,150,690 A 9/1992 Carter et al.
5,233,964 A 8/1993 Jamoua et al.
5,535,621 A * 7/1996 Glidewell et al. ..... 73/114.49
5,678,521 A 10/1997 Thompson et al.
5,699,254 A 12/1997 Abate et al.
5,701,870 A 12/1997 Gattshall et al.
5,774,822 A 6/1998 Maki et al.
5,812,433 A 9/1998 Kawabata et al.
5,908,463 A 6/1999 Akazaki et al.
5,941,210 A * 8/1999 Hill et al. ..... 123/305
6,076,508 A 6/2000 Nakano
6,123,058 A * 9/2000 Endou ..... 123/490
6,138,638 A * 10/2000 Morikawa ..... 123/295
6,243,643 B1 6/2001 Uematsu
6,276,337 B1 8/2001 Minato
6,390,082 B1 5/2002 Duffy et al.
6,467,452 B1 * 10/2002 Duffy et al. ..... 123/299
6,470,849 B1 10/2002 Duffy et al.
6,484,689 B1 11/2002 Hasegawa
6,499,469 B2 * 12/2002 Ogawa et al. ..... 123/478
6,691,671 B2 2/2004 Duffy et al.
6,694,953 B2 2/2004 Barnes et al.
6,705,278 B2 * 3/2004 McGee et al. ..... 123/299
6,766,789 B2 * 7/2004 Yamakado et al. ..... 123/490

(Continued)

OTHER PUBLICATIONS

PCT International Search Report and Written Opinion dated Sep. 9, 2008 relating to PCT/US2008/066520.

*Primary Examiner* — Willis R Wolfe, Jr.
*Assistant Examiner* — Johnny H Hoang
(74) *Attorney, Agent, or Firm* — Barnes & Thornburg LLP; J. Bruce Schelkopf

(57) ABSTRACT

The operation of a fuel injector for an internal combustion engine is controlled, wherein the fuel injector has an on time that includes a pull-in time during which injector current increases to a pull-in current followed by a hold time during which the injector current is limited to a hold current that is less than the pull-in current. A control circuit receives a pressure signal from a pressure sensor that corresponds to a pressure of fuel supplied to the fuel injector for injection into the engine, correlates the pressure signal with fuel pressure, and decreases the pull-in time with increasing fuel pressure.

21 Claims, 4 Drawing Sheets

U.S. PATENT DOCUMENTS

| | | | | |
|---|---|---|---|---|
| 6,799,559 | B2 * | 10/2004 | Mieny et al. | 123/490 |
| 6,823,834 | B2 * | 11/2004 | Benson et al. | 123/299 |
| 6,997,159 | B2 * | 2/2006 | Stockner et al. | 123/322 |
| 6,997,167 | B2 * | 2/2006 | Kitagawa et al. | 123/492 |
| 7,156,078 | B1 * | 1/2007 | Furuta | 123/478 |
| 7,278,396 | B2 * | 10/2007 | Leone et al. | 123/431 |
| 7,401,595 | B2 * | 7/2008 | Kimura et al. | 123/490 |
| 2002/0004696 | A1 | 1/2002 | Rekewitz et al. | |
| 2002/0195081 | A1 | 12/2002 | McGee et al. | |
| 2003/0089333 | A1 | 5/2003 | Duffy et al. | |
| 2003/0106534 | A1 | 6/2003 | Wilson et al. | |
| 2003/0121501 | A1 | 7/2003 | Barnes et al. | |
| 2004/0025849 | A1 | 2/2004 | West et al. | |
| 2005/0166891 | A1 * | 8/2005 | Fukasawa | 123/305 |
| 2009/0188469 | A1 * | 7/2009 | Tsukada et al. | 123/456 |
| 2009/0204306 | A1 * | 8/2009 | Goeke et al. | 701/100 |

* cited by examiner

SYSTEM AND METHOD FOR CONTROLLING FUEL INJECTION

FIELD OF THE INVENTION

The present invention relates generally to fuel systems for internal combustion engines, and more specifically to systems and methods for controlling fuel injection.

BACKGROUND

Fuel injectors for internal combustion engines may operate in a non-linear fashion under certain operating conditions. It is desirable to control such fuel injectors in a manner that results in more linear operation.

SUMMARY

The present invention may comprise one or more of the features recited in the attached claims, and/or one or more of the following features and combinations thereof. A method is provided for controlling operation of a fuel injector for an internal combustion engine. The fuel injector has an on time comprising a pull-in time during which injector current increases to a pull-in current followed by a hold time during which the injector current is limited to a hold current that is less than the pull-in current. The method may comprise receiving a pressure signal from a pressure sensor that corresponds to a pressure of fuel supplied to the fuel injector for injection into the engine, correlating the pressure signal with fuel pressure, and decreasing the pull-in time with increasing fuel pressure.

Decreasing the pull-in time may comprise decreasing the pull-in time only if the fuel pressure is above a threshold fuel pressure. The method may further comprise increasing the pull-in time with decreasing fuel pressure. Increasing the pull-in time may comprise limiting the pull-in time to a maximum pull-in time if the fuel pressure is below the threshold fuel pressure.

The method may further comprise monitoring a diagnostic state of the pressure sensor, and decreasing the pull-in time with increasing fuel pressure unless the diagnostic state of the pressure sensor corresponds to a sensor fault condition. The method may further comprise setting the pull-in time to a default pull-in time if the diagnostic state of the pressure sensor corresponds to a sensor fault condition.

A method of controlling operation of a fuel injector for an internal combustion engine is provided in which the fuel injector has an on time comprising a pull-in time during which injector current increases to a pull-in current followed by a hold time during which the injector current is limited to a hold current that is less than the pull-in current. This method may comprise receiving a pressure signal from a pressure sensor that corresponds to a pressure of fuel supplied to the fuel injector for injection into the engine, correlating the pressure signal with fuel pressure, and modifying the pull-in time based on the fuel pressure such that the pull-in time decreases with increasing fuel pressure and increases with decreasing fuel pressure.

Modifying the pull-in time based on the fuel pressure signal may comprise decreasing the pull-in time as the fuel pressure increases above a threshold fuel pressure, and increasing the pull-in time as the fuel pressure decreases toward the threshold fuel pressure. Modifying the pull-in time based on the fuel pressure may further comprise limiting the pull-in time to a maximum pull-in time if the fuel pressure decreases below the threshold fuel pressure.

Modifying the pull-in time based on the fuel pressure may comprise computing the pull-in time as a function of the fuel pressure. Alternatively, modifying the pull-in time based on the fuel pressure may comprise computing a pull-in time modifier as a function of the fuel pressure, and modifying the pull-in time using the pull-in time modifier.

The method may further comprise controlling operation of the fuel injector based on the on-time, the modified pull-in time and a start indicator corresponding to start, relative to a reference indicator, of the on-time of the fuel injector.

A system for controlling operation of a fuel injector for an internal combustion engine may comprise a pressure sensor configured to produce a pressure signal corresponding to a pressure of fuel supplied to the fuel injector for injection into the engine, and a control circuit. The control circuit may include a memory having instructions stored therein that are executable by the control circuit to process the pressure signal to determine a fuel pressure, to control an on-time of the fuel injector, wherein the on-time includes a pull-in time during which injector current increases to a pull-in current followed by a hold time during which the injector current is limited to a hold current that is less than the pull-in current, and to modify the pull-in time such that the pull-in time decreases with increasing fuel pressure.

The system may further comprise a fuel accumulator configured to supply the fuel to the fuel injector for injection into the engine. The pressure sensor may be positioned in fluid communication with the fuel accumulator and the pressure signal may correspond to a pressure of fuel within the fuel accumulator. Alternatively, the system may further comprise a fuel rail configured to supply the fuel to the fuel injector for injection into the engine. The pressure sensor may be positioned in fluid communication with the fuel rail and the pressure signal may correspond to a pressure fuel within the fuel rail.

The system may further comprise instructions stored in the memory that are executable by the control circuit to modify the pull-in time based on the fuel pressure signal by decreasing the pull-in time as the fuel pressure increases above a threshold fuel pressure, and by increasing the pull-in time as the fuel pressure decreases toward the threshold fuel pressure. The system may further comprise instructions stored in the memory that are executable by the control circuit to modify the pull-in time based on the fuel pressure by limiting the pull-in time to a maximum pull-in time if the fuel pressure decreases below the threshold fuel pressure.

The system may further comprise instructions stored in the memory that are executable by the control circuit to modify the pull-in time based on the fuel pressure by computing the pull-in time as a function of the fuel pressure. Alternatively, the system may further comprise instructions stored in the memory that are executable by the control circuit to modify the pull-in time based on the fuel pressure by computing a pull-in time modifier as a function of the fuel pressure, and then modifying the pull-in time using the pull-in time modifier.

The system may further comprise instructions stored in the memory that are executable by the control circuit to monitor a diagnostic state of the pressure sensor, and to modify the pull-in time such that the pull-in time decreases with increasing fuel pressure unless the diagnostic state of the pressure sensor corresponds to a sensor fault condition. The system may further comprise instructions stored in the memory that are executable by the control circuit to set the pull-in time to a default pull-in time if the diagnostic state of the pressure sensor corresponds to a sensor fault condition.

DESCRIPTION OF THE ILLUSTRATIVE EMBODIMENTS

For the purposes of promoting an understanding of the principles of the invention, reference will now be made to a number of illustrative embodiments shown in the attached drawings and specific language will be used to describe the same.

Figure 1:
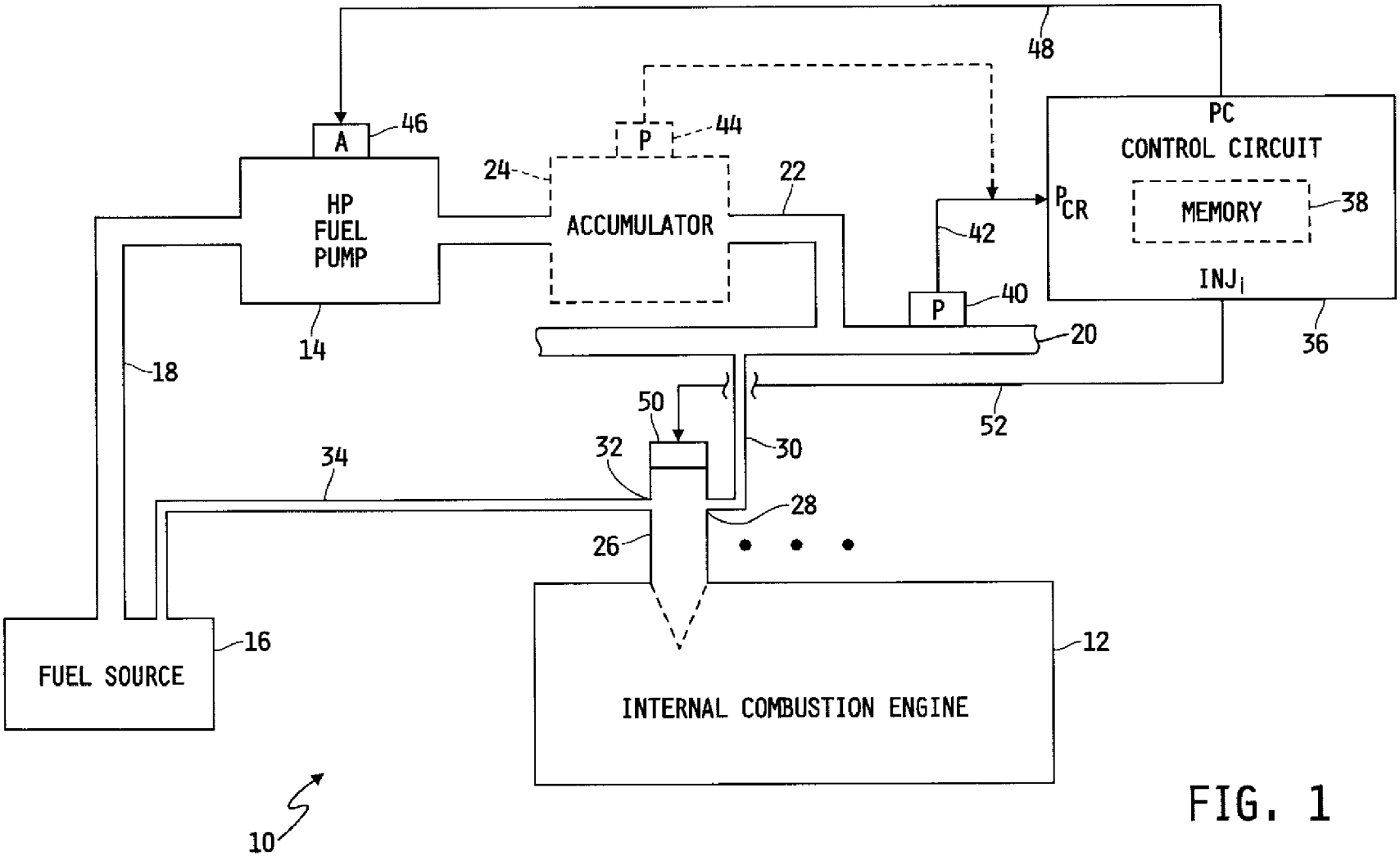
FIG. 1 is a block diagram of one illustrative embodiment of a system for controlling fuel injection into an internal combustion engine.

Referring now to FIG. 1, a block diagram of one illustrative embodiment of a system 10 for controlling fuel injection into an internal combustion engine 12 is shown. In the illustrated embodiment, a fuel system for the engine 12 includes a high pressure fuel pump 14 that is fluidly coupled to a source of fuel 16 via a fluid passageway 18, and is fluidly coupled to a fuel rail 20 via a fluid passageway 22. In one embodiment, the high pressure fuel pump 14 is fluidly coupled directly to the fuel rail 20 via the fluid passageway 22. In an alternative embodiment, the fuel system includes an accumulator 24 fluidly coupled between the high pressure fuel pump 14 and the fuel rail 20 as shown by dashed-line representation in FIG. 1. The accumulator 24 may be a conventional accumulator configured to store a quantity of high pressure fuel therein.

The fuel system further includes a number of fuel injectors each mounted to the engine 12 and fluid communication with one of a corresponding number of cylinders (not shown) of the engine 12. One such fuel injector 26 is illustrated in FIG. 1, although it will be understood that the engine 12 may include any number of fuel injectors. In the illustrated embodiment, the fuel injector 26 has a fuel inlet 28 that is fluidly coupled to the fuel rail 20 via a passageway 30, and a fuel spill port 32 that is fluidly coupled to the fuel source 16 via a fluid passageway 34. The fuel injector 26 is operable in a conventional manner to receive a quantity of fuel from the fuel rail 20 via the fluid passageway 30, to dispense some of the fuel into the cylinder of the engine 12 and to return the remaining fuel to the fuel source 16 via the fluid passageway 34.

The system 10 further includes a control circuit 36 configured to control the overall operation of the engine 12, and specifically, operation of the fuel system just described. In one embodiment, the control circuit 36 is a microprocessor-based control circuit typically referred to as an electronic or engine control module (ECM), or electronic or engine control unit (ECU). It will be understood, however, that the control circuit 36 may generally be or include one or more general purpose or application specific control circuits arranged and operable as will be described hereinafter.

In the illustrated embodiment, the control circuit 36 includes, or is coupled to, a memory unit 38 that has stored therein a number of software algorithms that are executable by the control circuit 36 to control various operations of the engine 12 and of the fuel system. The control circuit 36 includes a number of inputs that receive signals corresponding to various operating conditions of the engine 12 and of the fuel system. In the embodiments of system 10 that do not include the accumulator 24, for example, the system 10 includes a conventional pressure sensor 40 that is positioned in fluid communication with the fuel rail 20, and that is electrically connected to an input, $P_{CR}$, of the control circuit 36 via a signal path 42. Alternatively or additionally, in embodiments of the system 10 that include an accumulator 24, the system 10 includes a conventional pressure sensor 44 that is positioned and fluid communication with the accumulator 24, and that is electrically connected to the input $P_{CR}$, of the control circuit 36 as shown by-line representation in FIG. 1. In the former case, the pressure sensor 40 is operable to produce a signal on signal path 42 that is indicative of the fuel pressure within the fuel rail 20, and in the latter case, the pressure sensor 44 is operable to produce a signal that is indicative of the fuel pressure within the accumulator 24.

The control circuit 36 further includes a number of outputs via which the control circuit 36 can control, pursuant to one or more software algorithms being executed by the control circuit 36, various operations of the engine 12 and of the fuel system. For example, the system 10 includes a conventional fuel pump actuator 46 that is electrically connected to a pump command output, PC, of the control circuit 36 via a signal path 48. The fuel pump actuator 46 is configured to be responsive to control signals produced by the control circuit 36 on the signal path 48 to control operation of the fuel pump 14 in a conventional manner. Each of the fuel injectors further includes an electronic actuator by which the control circuit 36 may control the operation thereof. For example, the fuel injector 26 illustrated in FIG. 1 includes an electronic actuator 50, e.g., a conventional solenoid, that is electrically connected to an injector output, $INJ_i$, of the control circuit 36 via a signal path 52. The electronic actuator 50 is configured to be responsive to control signals produced by the control circuit 36 on the signal path 52 to control operation of the fuel injector 26 as will be described in greater detail hereinafter.

Figure 2:
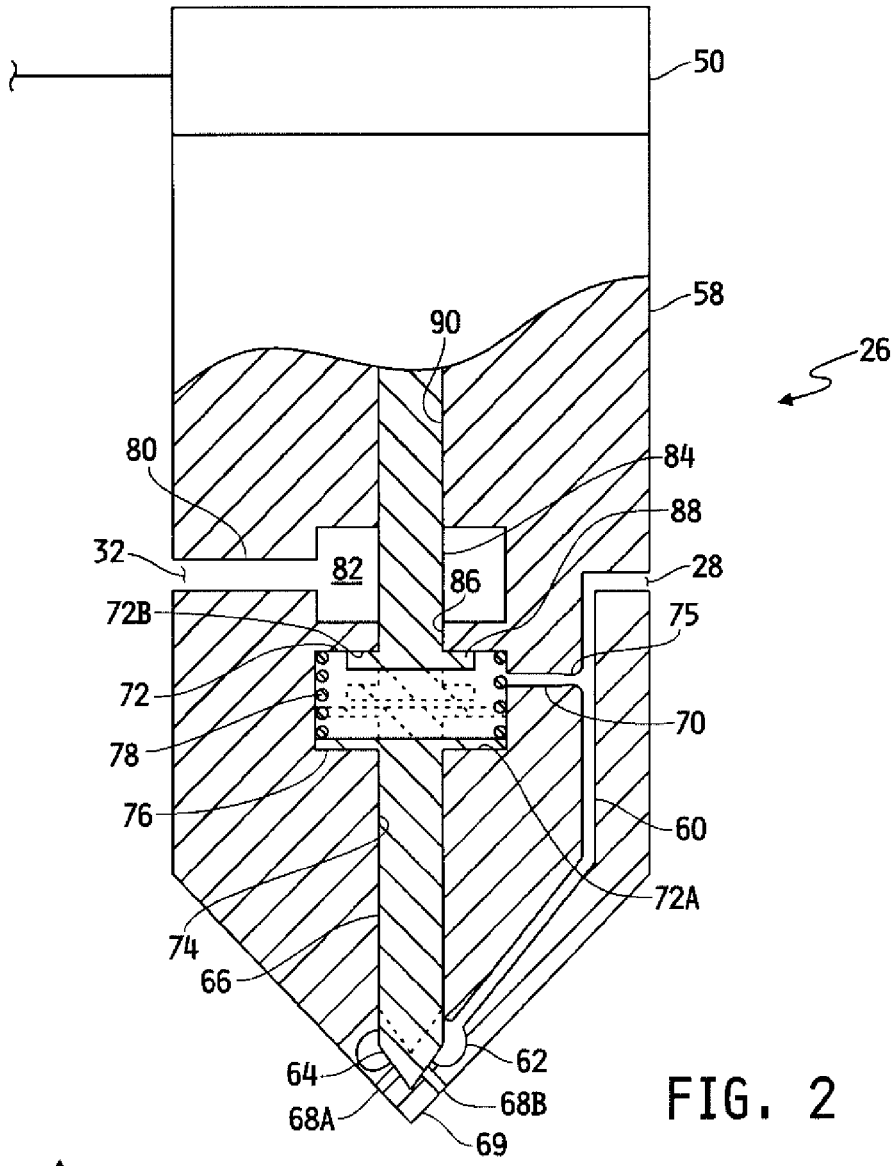
FIG. 2 is a partial cross sectional view of one illustrative embodiment of the fuel injector illustrated in FIG. 1.

Referring now to FIG. 2, a partial cross-sectional view of one illustrative embodiment of the fuel injector 26 of FIG. 1 is shown. In the illustrated embodiment, the fuel injector 26 includes an injector body 58 having a fluid passageway 60 that extends between the fuel inlet 28 and a fuel collection area or sac 62. A needle valve 66 is received within a bore 74 that extends between a balance chamber 72 and a number of nozzle holes, e.g., 68A and 68B, at the fuel dispensing tip 69 of the fuel injector 26. The needle valve 66 defines a tapered tip 64 at one end, and a head portion 76 at an opposite end. The head portion 76 is normally biased against a bottom surface 72A of the balance chamber 72 via a spring 78 that extends between a top surface of the head portion 76 and an upper surface 72B of the balance chamber 72. Another fluid passageway 70 extends between the pressure balance chamber 72 and the fluid passageway 60, and the fluid passageway 70 defines a flow restriction area 75 between the fluid passageway 60 and the pressure balance chamber 72.

Another fluid passageway 80 is defined between the fuel spill port 32 of the injector 26 and a fuel spill chamber 82 that is defined between the solenoid 50 and the pressure balance chamber 72. A plunger 84 is positioned within axially aligned bores 86 and 90 defined in the body 58 of the fuel injector 26, and the plunger 84 defines a head portion 88 at one end thereof. The opposite end of the plunger 88 is coupled to, and may be actuated by, the electronic actuator 50 in a conventional manner. The head portion 88 of the plunger 84 is normally biased, e.g., by a conventional spring (not shown), when the fuel injector 26 is not injecting fuel such that the head portion 88 is in contact with the upper surface 72B of the pressure balance chamber 72 and such that the pressure balance chamber 72 and the fuel spill chamber 82 are not in fluid communication.

Operation of the fuel injectors 26 is conventional in that fuel supplied by the fuel rail 20 enters the fuel inlet 28, and is directed by the fluid passageways 60 and 70 into the fuel collection area or sac 62 and into the pressure balance chamber 72 respectively. Because the fuel pressures in the pressure balance chamber 72 and fuel collection area or sac 62 are essentially the same, the bias of the spring 78 maintains the head portion 76 of the needle valve 66 in contact with the bottom surface 72A of the pressure balance chamber 72, as illustrated in FIG. 2, so that the tapered tip 64 of the needle valve 66 closes the nozzle hole 68A and 68B. With the needle valve 66 in the illustrated position, fuel in the fuel collection area or sac 62 does not flow through the nozzle holes 68A and 68B.

When it is desirable to inject fuel from the fuel injector 26 into a corresponding cylinder of the engine 12, the control circuit 36 actuates the electronic actuator 50 by producing a control signal on the signal path 48. The electronic actuator 50 is responsive to the control signal on the signal path 48 to force the plunger 84 downwardly toward the needle valve 66 such that the head portion 88 is drawn away from the upper surface 72B of the pressure balance chamber 72, as illustrated by dashed-line representation in FIG. 2. When this occurs, fuel within the pressure balance chamber 72 passes through the bore 86 into the fuel spill chamber 82, and exits the fuel injector 26 via the fuel spill port 32. As the fuel within the pressure balance chamber 72 passes into the fuel spill chamber 82, the fuel pressure within the pressure balance chamber 72 decreases. At some point in this process, the fuel pressure within the fuel collection area or sac 62 exceeds the downward force on the head portion 76 of the needle valve 66 that results from a combination of the biasing force of the spring 78 and the pressure of fuel remaining within the pressure balance chamber 72. When this occurs, the fuel pressure within the fuel collection area or sac 62 acts upon the tapered end 64 of the needle valve 66 and forces the needle valve 66 upwardly, overcoming the bias of the spring 78 as illustrated by dashed-line representation in FIG. 2. Fuel collected within the fuel collection area or sac 62 is thus injected, under high pressure, into a corresponding cylinder of the engine 12 via the nozzle holes 68A and 68B.

When it is desirable to stop fuel injection, the control circuit 36 de-actuates the electronic actuator 50, which causes the head portion 88 of the plunger 84 to again be forced against the upper surface 72B of the pressure balance chamber 72, thereby closing the fluid passageway between the pressure balance chamber 72 and the fuel spill chamber 82. Fuel from the fuel rail 20 then fills the pressure balance chamber 72 as described above, and when the combined pressure of the fuel within the pressure balance chamber 72 and the biasing force of the spring 78 become greater than the fuel pressure within the fuel collection area or sac 62, the needle valve 66 is forced downwardly so that the fluid passageway between the fuel collection area or sac 62 and the number of nozzle 68A and 68B is closed.

Figure 3:
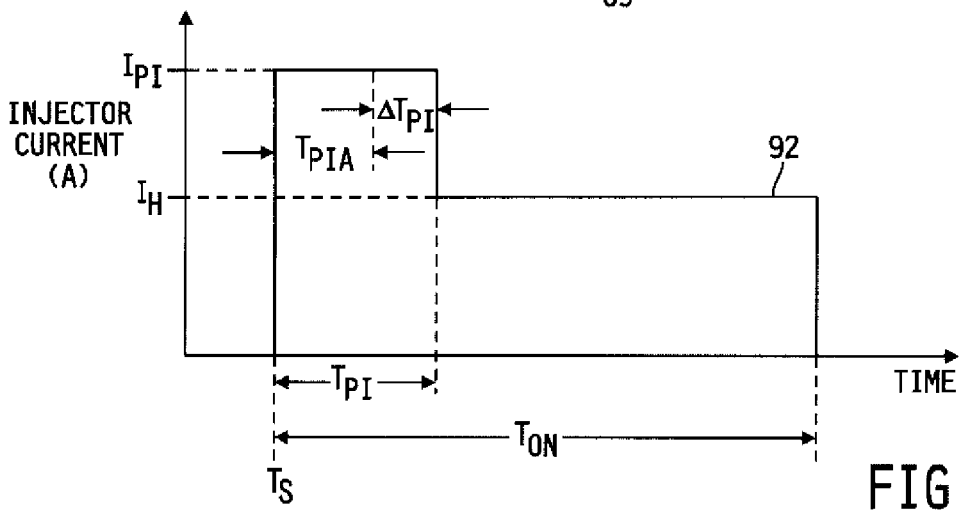
FIG. 3 is a plot of injector current vs. time illustrating one illustrative technique for controlling operation of the fuel injector illustrated FIG. 1.

Referring now to FIG. 3, a plot of injector current 92 vs. time is shown, wherein the injector current 92 is the current drawn by the electronic actuator 50 during the above-described process. The injector current waveform 92 follows a conventional pull-in and hold profile in which the injector current 92 is controlled by the control circuit 36 at an injection start time, $T_S$, (typically referred to as start-of-injection or SOI) to a relatively high pull-in current, $I_{PI}$, for a fixed "pull-in" time, $T_{PI}$, after which the injector current 92 is abruptly switched to a relatively lower "hold" current, $I_H$, for the remaining duration of the total injector on-time, $T_{ON}$.

With injectors 26 of the type just described, fueling-to-injector on-time relationships can become increasingly non-linear with increasing fuel rail (or fuel accumulator) pressures. It has been discovered through experimentation that much of this non-linearity is caused by varying injected fuel quantity-to-injector on-time gain resulting from the motion of the plunger 84 relative to commanded injector off times, where the injected fuel quantity-to-injector on-time (or fueling-to-on-time) gain is defined as a ratio of the change in injected fuel quantity and the change in injector on-time. For example, when the plunger 84 is actuated pursuant to an "on" command provided by the control circuit 36 to the electronic actuator 50 on the signal path 48, and it is then de-actuated pursuant to an "off" command just before the plunger 84 has reached its fully open position (see FIG. 2), the plunger 84 "bounces" off the full open stop and closes quickly. When this occurs, the fueling-to-on-time gain in this region is small. Conversely, when the plunger 84 is de-actuated well before it has reached its fully open position, it returns, without hitting the full open stop, to the closed position much more slowly than in the previous case. When this occurs, the fueling-to-on-time gain is relatively high. In contrast, when the plunger 84 is de-actuated after it has reached its fully open position, it closed more slowly than in the former case but faster than in the latter case. Consequently, the fueling-to-on-time gain is smaller than in the former case but greater than in the latter case.

Figure 4:
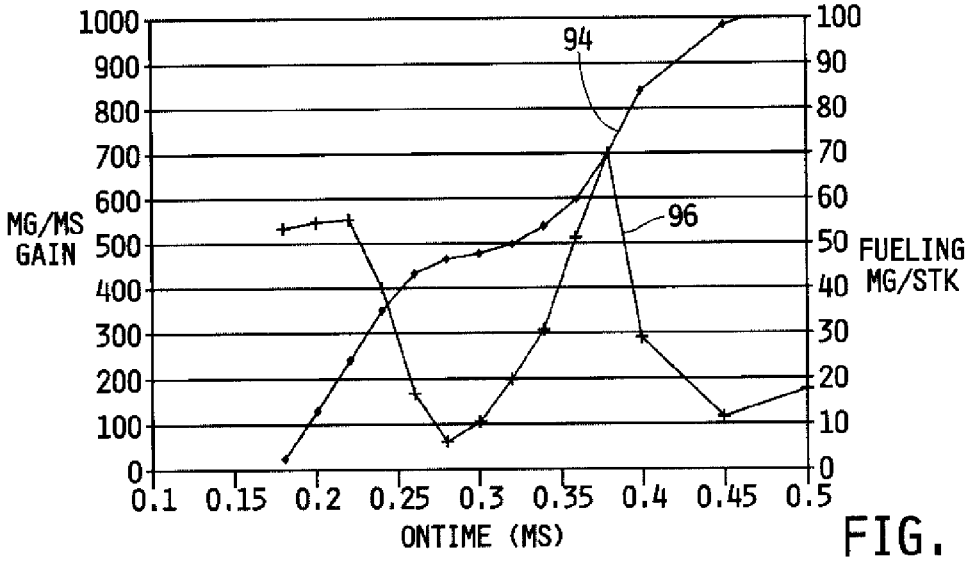
FIG. 4 is an exemplary plot of fuel injection quantity-to-injector on-time gain vs. injector on-time for the fuel injector illustrated in FIG. 1.

The effects of fueling-to-on-time gain on the linearity of the injector-to-fueling on-time relationship increase, i.e., become more noticeable, as the pressure of fuel supplied to the injector increases because at higher fuel pressures the ballistic motion of the plunger 84 has a greater affect on the fueling-to-on-time gain. Referring to FIG. 4, for example, plots of injector fueling (mg/stk) vs. injector on-time 94 and fueling-to-on-time gain (mg/ms) vs. injector on-time 96 are shown for a fuel pressure of 2200 bar. In the most non-linear region of the injector fueling waveform 96, e.g., between 0.27 and 0.4 ms, it is observed that the fueling-to-on-time gain 96 changes significantly.

Figure 5:
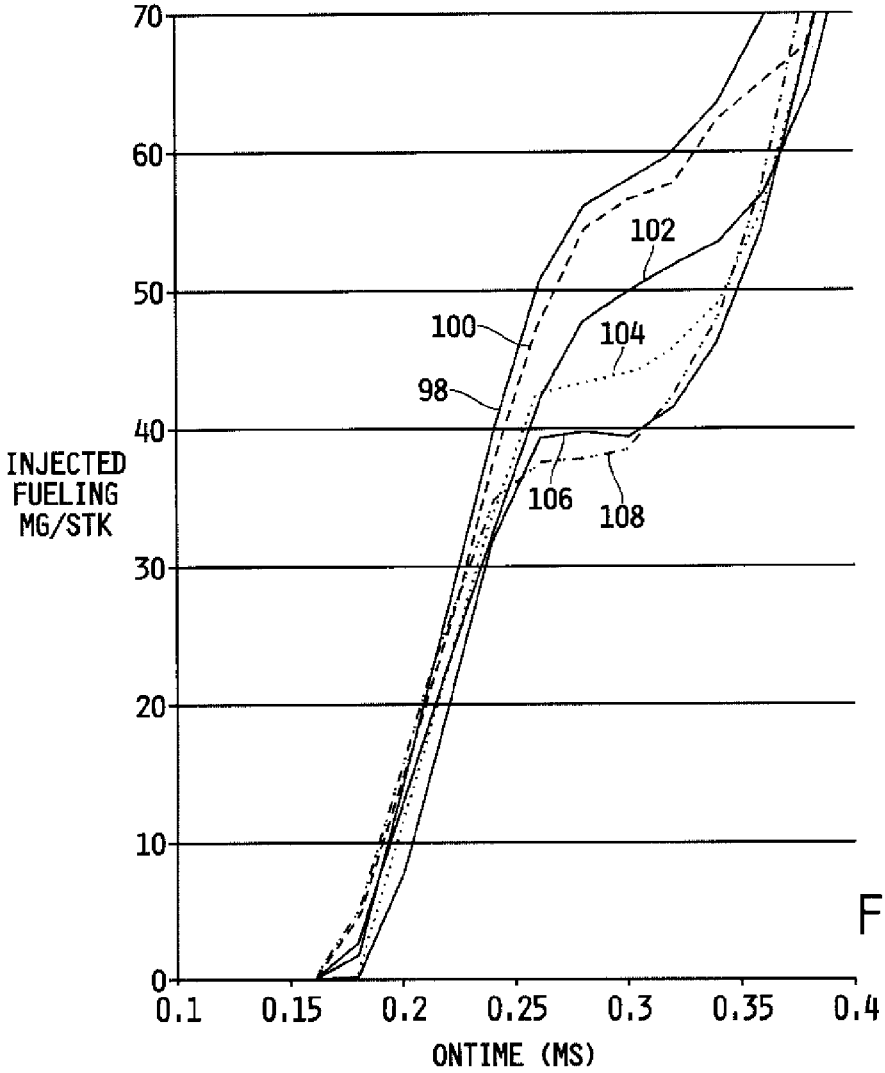
FIG. 5 is a plot of fuel injection quantity vs. injector on-time for six separate fuel injectors included in the fuel system of FIG. 1.

When operating at high fuel pressures wherein the fueling-to-injector on-time relationship 96 is more highly non-linear, as illustrated in FIG. 4, injector-to-injector variations can lead to significantly large variations in fueling between the cylinders of the engine 12. Referring to FIG. 5, for example, a plot of fueling-to-injector on-times 98, 100, 102, 104, 106 and 108 for six corresponding fuel injectors in a 6-cylinder implementation at 2200 bar fuel pressure is shown. FIG. 5 demonstrates that the amount of fuel injected by each fuel injector vs. injector on-time can vary significantly.

Referring again to FIG. 3, it has been determined through experimentation that the actual pull-in time of the fuel injector 26 varies as a function of the pressure fuel supplied to the fuel injector 26. In particular, it has been determined that the actual pull-in time decreases with increasing fuel pressure. It has further been determined that if the conventional fixed pull-in time, $T_{PI}$, is dynamically modified to an adjusted pull-in time, $T_{PIA}$, as a function of fuel pressure, the fueling-to-injector on-time relationship can be made more linear. In one illustrative embodiment, the adjusted pull-in time, $T_{PIA}$, may be continually computed as a function of the fuel pressure, $P_{CR}$. Alternatively, the adjusted pull-in time may be continually computed as a function of the fuel pressure, $P_{CR}$, and of the conventional fixed pull-in time, $T_{PI}$, and then applied to $T_{PI}$ in the form of an offset $\Delta T_{PI}$, as shown in FIG. 3, or alternatively in the form of a fractional multiplier. Those skilled in the art will recognize other conventional techniques for computing the adjusted pull-in time, $T_{PIA}$, as a function of at least the pressure fuel supplied to the fuel injector 26, and such other conventional techniques are contemplated by this disclosure.

Figure 6:
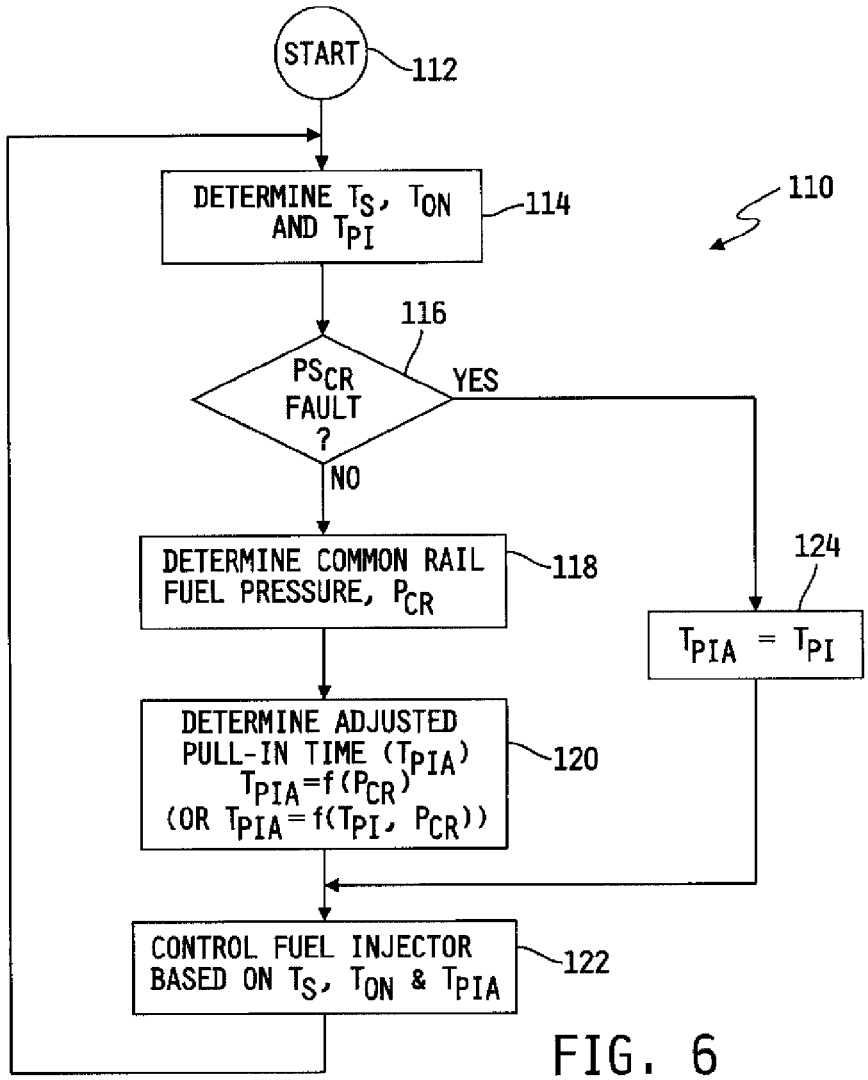
FIG. 6 is a flowchart of one illustrative embodiment of a software algorithm that is executable by the control circuit of FIG. 1 to control operation of the fuel injector illustrated in FIG. 1.

Referring now to FIG. 6, a flowchart of one illustrative embodiment of a software algorithm 110 is shown for controlling operation of fuel injectors of the type described herein as a function of fuel pressure. Illustratively, the software algorithm 110 is provided in the form of at least one set of instructions that is stored in the memory unit 38 and that is executed by the control circuit 36 to control the pull-in time, $T_{PI}$, of the fuel injectors, via control of the control signals produced by the control circuit 36 on the signal path 52, as a function of fuel rail pressure, $P_{CR}$. Further illustratively, the algorithm 110 is executed separately for each of the number of fuel injectors 26 associated with the engine 12.

The algorithm 110 begins at step 112, and thereafter at step 114 the control circuit 36 is operable to determine, with reference to FIG. 3, default values of $T_S$, $T_{ON}$ and $T_{PI}$ according to conventional techniques. Thereafter at step 116, the control circuit 36 is operable to determine in a conventional manner whether any pressure sensor faults associated with the fuel pressure sensor 40 (or 44) are active. If not, the control circuit 36 is thereafter operable at step 118 to determine the common rail fuel pressure, $P_{CR}$. In embodiments that do not include an accumulator 24, the control circuit 36 is operable to execute step 118 by processing the pressure signal produced by the pressure sensor 40. In embodiments that include an accumulator 24, the control circuit 36 is operable to execute step 118 by processing the pressure signal produced by the pressure sensor 44 and/or the pressure signal produced by the pressure sensor 40 if the pressure sensor 40 is included in the system.

Following step 118, the control circuit 36 is operable at step 120 to determine the adjusted pull-in time, $T_{PIA}$. In one embodiment, the control circuit 36 is operable to compute $T_{PIA}$ as a function of the fuel rail pressure, $P_{CR}$. In one alternative embodiment, the control circuit 36 is operable to compute $T_{PIA}$ as a function of $P_{CR}$ and of the fixed pull-in time, $T_{PI}$ that was determined at step 114. Illustratively, the memory unit 38 may include a table that is populated to map $P_{CR}$ (and, in some embodiments, $T_{PI}$) to values of $T_{PIA}$, although the control circuit 36 may alternatively be configured to compute $T_{PIA}$ according to one or more equations, graphs or the like. The algorithm 110 may be configured, as illustrated in FIG. 6, to include step 120 for all values of the fuel pressure, $P_{CR}$. Alternatively, the algorithm 110 may be modified to provide for the execution of step 120 only if it is first determined that the fuel rail pressure, $P_{CR}$, is greater than a predetermined threshold fuel pressure. Such modifications would be a mechanical step for a skilled artisan. In either or any case, step 120 may include not only decreasing the pull-in time with increasing fuel pressure, but also increasing the pull-in time with decreasing fuel pressure if the pull-in time had been decreased in one or more previous engine cycles to provide for continual, bi-directional adjustment of the pull-in time. In such cases, the step 120 may include a maximum pull-in time, e.g., equal to the default pull-in time, $T_{PI}$, and/or a minimum pull-in time below which the pull-in time, $T_{PI}$, cannot be reduced. Those skilled in the art will recognize other conventional techniques for computing the adjusted pull-in time, $T_{PIA}$, as a function of at least the pressure fuel supplied to the fuel injector 26, and such other conventional techniques are contemplated by this disclosure. Following step 118, the control circuit 36 is operable at step 122 to control the fuel injector 26 based on $T_S$, $T_{ON}$ and $T_{PIA}$ in a conventional manner. From step 122, the algorithm 110 loops back to step 114 for continual execution of the algorithm 110.

If, at step 116, it is determined that any pressure sensor faults are active, e.g., any fault that calls into question the accuracy of signals produced by the sensor 40 (and/or the sensor 44), execution of the algorithm 110 advances to step 124 where the control circuit 36 is operable to assign the adjusted pull-in time value, $T_{PIA}$, to the default pull-in time, $T_{PI}$. Thereafter, the algorithm 110 advances to step 122.

Figure 7:
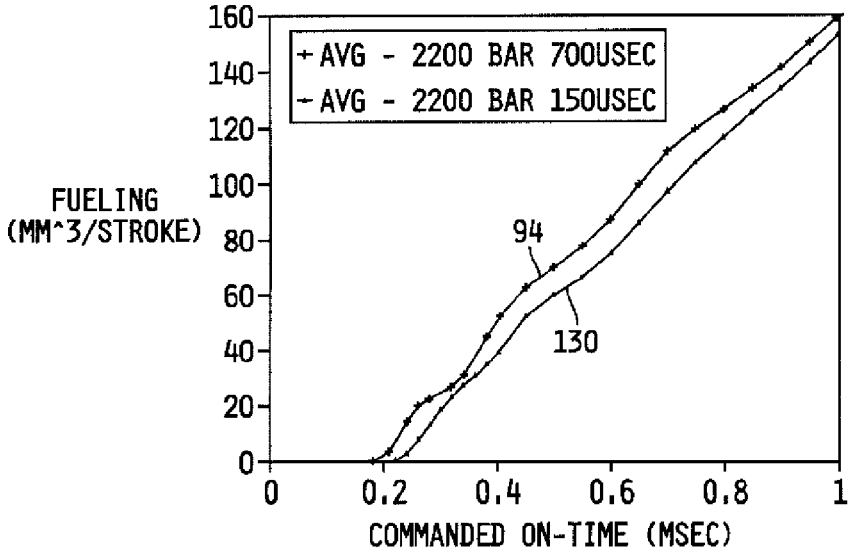
FIG. 7 is a plot of fuel injection quantity vs. injector on-time comparing the fuel injection quantity signal of FIG. 4 with a fuel injector quantity signal resulting from the execution of the algorithm of FIG. 6.

Referring now to FIG. 7, plots of fueling vs. injector on-time 94 and 130 are shown. The fueling vs. injector on-time waveform 94 is identical to that illustrated in FIG. 4, and is the result of operating the fuel injector 26 according to conventional techniques at a fuel pressure of 2200 bar with an injector pull-in time, $T_{PI}$, of 700 ms. In contrast, the fueling vs. injector on-time waveform 130 represents operation of the same fuel injector 26 at a fuel pressure of 220 bar, but with an adjusted injector pull-in time, $T_{PIA}$, computed according to the algorithm 110 of FIG. 6, of 150 ms. It is apparent from FIG. 7 that the algorithm 110 provides for an improvement in the linearity of the fueling vs. injector on-time.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected.

What is claimed is:

1. A method of controlling operation of a fuel injector for an internal combustion engine, the fuel injector having an on time comprising a pull-in time during which injector current is controlled to a pull-in current followed by a hold time during which the injector current is limited to a hold current that is less than the pull-in current, the method comprising:

receiving a pressure signal from a pressure sensor that corresponds to a pressure of fuel supplied to the fuel injector for injection into the engine, correlating the pressure signal with fuel pressure, and decreasing the pull-in time with increasing fuel pressure.

2. The method of claim 1 wherein decreasing the pull-in time comprises decreasing the pull-in time only if the fuel pressure is above a threshold fuel pressure.

3. The method of claim 2 further comprising increasing the pull-in time with decreasing fuel pressure.

4. The method of claim 3 wherein increasing the pull-in time comprises limiting the pull-in time to a maximum pull-in time if the fuel pressure is below the threshold fuel pressure.

5. The method of claim 1 further comprising:

monitoring a diagnostic state of the pressure sensor, and decreasing the pull-in time with increasing fuel pressure unless the diagnostic state of the pressure sensor corresponds to a sensor fault condition.

6. The method of claim 5 further comprising setting the pull-in time to a default pull-in time if the diagnostic state of the pressure sensor corresponds to a sensor fault condition.

7. A method of controlling operation of a fuel injector for an internal combustion engine, the fuel injector having an on time comprising a pull-in time during which injector current is controlled to a pull-in current followed by a hold time during which the injector current is limited to a hold current that is less than the pull-in current, the method comprising:

receiving a pressure signal from a pressure sensor that corresponds to a pressure of fuel supplied to the fuel injector for injection into the engine, correlating the pressure signal with fuel pressure, and modifying the pull-in time based on the fuel pressure such that the pull-in time decreases with increasing fuel pressure and increases with decreasing fuel pressure.

8. The method of claim 7 wherein modifying the pull-in time based on the fuel pressure signal comprises:

decreasing the pull-in time as the fuel pressure increases above a threshold fuel pressure, and increasing the pull-in time as the fuel pressure decreases toward the threshold fuel pressure.

9. The method of claim 8 wherein modifying the pull-in time based on the fuel pressure further comprises limiting the pull-in time to a maximum pull-in time if the fuel pressure decreases below the threshold fuel pressure.

10. The method of claim 7 wherein modifying the pull-in time based on the fuel pressure comprises computing the pull-in time as a function of the fuel pressure.

11. The method of claim 7 wherein modifying the pull-in time based on the fuel pressure comprises:

computing a pull-in time modifier as a function of the fuel pressure, and modifying the pull-in time using the pull-in time modifier.

12. The method of claim 7 further comprising controlling operation of the fuel injector based on the on-time, the modified pull-in time and a start indicator corresponding to start, relative to a reference indicator, of the on-time of the fuel injector.

13. A system for controlling operation of a fuel injector for an internal combustion engine, comprising:

a pressure sensor configured to produce a pressure signal corresponding to a pressure of fuel supplied to the fuel injector for injection into the engine, and a control circuit including a memory having instructions stored therein that are executable by the control circuit to process the pressure signal to determine a fuel pressure, to control an on-time of the fuel injector, the on-time including a pull-in time during which injector current is controlled to a pull-in current followed by a hold time during which the injector current is limited to a hold current that is less than the pull-in current, and to modify the pull-in time such that the pull-in time decreases with increasing fuel pressure.

14. The system of claim 13 further comprising a fuel accumulator configured to supply the fuel to the fuel injector for injection into the engine, wherein the pressure sensor is positioned in fluid communication with the fuel accumulator and the pressure signal corresponds to a pressure of fuel within the fuel accumulator.

15. The system of claim 13 further comprising a fuel rail configured to supply the fuel to the fuel injector for injection into the engine, wherein the pressure sensor is positioned in fluid communication with the fuel rail and the pressure signal corresponds to a pressure fuel within the fuel rail.

16. The system of claim 13 further comprising instructions stored in the memory that are executable by the control circuit to modify the pull-in time based on the fuel pressure signal by decreasing the pull-in time as the fuel pressure increases above a threshold fuel pressure, and by increasing the pull-in time as the fuel pressure decreases toward the threshold fuel pressure.

17. The system of claim 16 further comprising instructions stored in the memory that are executable by the control circuit to modify the pull-in time based on the fuel pressure by limiting the pull-in time to a maximum pull-in time if the fuel pressure decreases below the threshold fuel pressure.

18. The system of claim 13 further comprising instructions stored in the memory that are executable by the control circuit to modify the pull-in time based on the fuel pressure by computing the pull-in time as a function of the fuel pressure.

19. The system of claim 13 further comprising instructions stored in the memory that are executable by the control circuit to modify the pull-in time based on the fuel pressure by computing a pull-in time modifier as a function of the fuel pressure, and then modifying the pull-in time using the pull-in time modifier.

20. The system of claim 13 further comprising instructions stored in the memory that are executable by the control circuit to monitor a diagnostic state of the pressure sensor, and to modify the pull-in time such that the pull-in time decreases with increasing fuel pressure unless the diagnostic state of the pressure sensor corresponds to a sensor fault condition.

21. The system of claim 20 further comprising instructions stored in the memory that are executable by the control circuit to set the pull-in time to a default pull-in time if the diagnostic state of the pressure sensor corresponds to a sensor fault condition.

* * * * *